US011111556B2

(12) United States Patent
Terazawa et al.

(10) Patent No.: US 11,111,556 B2
(45) Date of Patent: Sep. 7, 2021

(54) ABRASION-RESISTANT STEEL PLATE AND METHOD OF PRODUCING ABRASION-RESISTANT STEEL PLATE

(71) Applicant: JFE STEEL CORPORATION, Tokyo (JP)

(72) Inventors: Yusuke Terazawa, Tokyo (JP); Naoki Takayama, Tokyo (JP); Kenji Hayashi, Tokyo (JP); Kazukuni Hase, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 293 days.

(21) Appl. No.: 16/092,553

(22) PCT Filed: Apr. 19, 2016

(86) PCT No.: PCT/JP2016/002101
§ 371 (c)(1),
(2) Date: Oct. 10, 2018

(87) PCT Pub. No.: WO2017/183059
PCT Pub. Date: Oct. 26, 2017

(65) Prior Publication Data
US 2019/0203314 A1 Jul. 4, 2019

(51) Int. Cl.
*C21D 8/02* (2006.01)
*C22C 38/00* (2006.01)
(Continued)

(52) U.S. Cl.
CPC ..... *C21D 9/46* (2013.01); *B22D 11/001* (2013.01); *B22D 11/041* (2013.01);
(Continued)

(58) Field of Classification Search
None
See application file for complete search history.

(56) References Cited

U.S. PATENT DOCUMENTS 9,738,957 B2 8/2017 Keiji et al.
9,879,334 B2 1/2018 Keiji et al.
(Continued)

FOREIGN PATENT DOCUMENTS

CN 103459635 A 12/2013
JP H0551691 A 3/1993
(Continued)

OTHER PUBLICATIONS

Sep. 4, 2020, Office Action issued by the United States Patent and Trademark Office in the U.S. Appl. No. 16/092,272.
(Continued)

*Primary Examiner* — Patricia L. Hailey
*Assistant Examiner* — Christopher D. Moody
(74) *Attorney, Agent, or Firm* — Kenja IP Law PC

(57) ABSTRACT

An abrasion-resistant steel plate comprises: a specific chemical composition; and a microstructure in which a volume fraction of martensite at a depth of 1 mm from a surface of the abrasion-resistant steel plate is 90% or more, and a prior austenite grain size in a plate thickness central part at the mid-thickness of the abrasion-resistant steel plate is 80 μm or less, wherein hardness at a depth of 1 mm from the surface of the abrasion-resistant steel plate is 460 to 590 HBW 10/3000 in Brinell hardness, and a concentration [Mn] of Mn in mass % and a concentration [P] of P in mass % in a plate thickness central segregation area satisfy 0.04[Mn]+[P]<0.50.

13 Claims, 2 Drawing Sheets

(51) Int. Cl.

| | |
|---|---|
| ***C22C 38/02*** | (2006.01) |
| ***C22C 38/04*** | (2006.01) |
| ***C22C 38/06*** | (2006.01) |
| ***C22C 38/20*** | (2006.01) |
| ***C22C 38/22*** | (2006.01) |
| ***C22C 38/24*** | (2006.01) |
| ***C22C 38/26*** | (2006.01) |
| ***C22C 38/50*** | (2006.01) |
| ***C22C 38/54*** | (2006.01) |
| ***C22C 38/18*** | (2006.01) |
| ***C22C 38/40*** | (2006.01) |
| ***B22D 11/12*** | (2006.01) |
| ***C22C 38/38*** | (2006.01) |
| ***C22C 38/32*** | (2006.01) |
| ***C22C 38/28*** | (2006.01) |
| ***B22D 11/00*** | (2006.01) |
| ***C21D 9/46*** | (2006.01) |
| ***C22C 38/58*** | (2006.01) |
| ***B22D 11/041*** | (2006.01) |
| ***C21D 6/00*** | (2006.01) |
| ***C22C 38/44*** | (2006.01) |

(52) U.S. Cl.

CPC ..... *B22D 11/1206* (2013.01); *C21D 6/004* (2013.01); *C21D 6/005* (2013.01); *C21D 6/008* (2013.01); *C21D 8/0205* (2013.01); *C21D 8/0226* (2013.01); *C21D 8/0263* (2013.01); *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/18* (2013.01); *C22C 38/20* (2013.01); *C22C 38/22* (2013.01); *C22C 38/24* (2013.01); *C22C 38/26* (2013.01); *C22C 38/28* (2013.01); *C22C 38/32* (2013.01); *C22C 38/38* (2013.01); *C22C 38/40* (2013.01); *C22C 38/44* (2013.01); *C22C 38/50* (2013.01); *C22C 38/58* (2013.01); *C21D 2211/001* (2013.01); *C21D 2211/008* (2013.01)

(56) References Cited

U.S. PATENT DOCUMENTS

| | | | | |
|---|---|---|---|---|
| 10,060,005 | B2 | 8/2018 | Kazuo et al. | |
| 2006/0162826 | A1 | 7/2006 | Beguinot et al. | |
| 2013/0095347 | A1* | 4/2013 | Kawasaki | B21B 1/026 428/684 |
| 2014/0124102 | A1 | 5/2014 | Aiwen et al. | |
| 2015/0232971 | A1* | 8/2015 | Miura | C21D 8/0263 148/330 |
| 2015/0368742 | A1* | 12/2015 | Shibata | C21D 8/0205 148/652 |
| 2016/0208352 | A1 | 7/2016 | Pasi et al. | |
| 2016/0304981 | A1* | 10/2016 | Song | C21D 8/0236 |
| 2017/0081741 | A1* | 3/2017 | Tabata | C21D 8/0205 |
| 2017/0081742 | A1* | 3/2017 | Tabata | B21D 22/20 |
| 2017/0096724 | A1 | 4/2017 | Kazuo et al. | |

FOREIGN PATENT DOCUMENTS

| | | | |
|---|---|---|---|
| JP | 2006506527 | A | 2/2006 |
| JP | 2007092155 | A | 4/2007 |
| JP | 2007296542 | A | 11/2007 |
| JP | 2008018439 | A | 1/2008 |
| JP | 2009030094 | A | 2/2009 |
| JP | 4259145 | B2 | 4/2009 |
| JP | 4645307 | B2 | 3/2011 |
| JP | 2011214120 | A | 10/2011 |
| JP | 5145804 | B2 | 2/2013 |
| JP | 5145805 | B2 | 2/2013 |
| JP | 2014025130 | A | 2/2014 |
| WO | 2015028557 | A1 | 3/2015 |
| WO | 2015147216 | A1 | 10/2015 |

OTHER PUBLICATIONS

Jul. 26, 2016, International Search Report issued in the International Patent Application No. PCT/JP2016/002101.

Nov. 15, 2019, Office Action issued by the Korean Intellectual Property Office in the corresponding Korean Patent Application No. 10-2018-7030124 with English language Concise Statement of Relevance.

Jan. 22, 2019, the Extended European Search Report issued by the European Patent Office in the corresponding European Patent Application No. 16899334.3.

Oct. 11, 2019, Office Action issued by the China National Intellectual Property Administration in the corresponding Chinese Patent Application No. 201680084500.5 with English language search report.

May 16, 2019, Office Action issued by the IP Australia in the corresponding Australian Patent Application No. 2016403221.

* cited by examiner

ABRASION-RESISTANT STEEL PLATE AND METHOD OF PRODUCING ABRASION-RESISTANT STEEL PLATE

TECHNICAL FIELD

The present disclosure relates to an abrasion-resistant steel plate, and particularly to an abrasion-resistant steel plate that can achieve both delayed fracture resistance and abrasion resistance at high level and low cost. The present disclosure also relates to a method of producing the abrasion-resistant steel plate.

BACKGROUND

Industrial machines, parts, conveying devices (e.g. power shovels, bulldozers, hoppers, bucket conveyors, rock crushers), and the like used in fields such as construction, civil engineering, and mining are exposed to abrasion such as abrasive abrasion, sliding abrasion, and impact abrasion by rocks, sand, ore, etc. Steel used in such industrial machines, parts, carriers, and the like is therefore required to have excellent abrasion resistance, in order to improve life.

It is known that the abrasion resistance of steel can be improved by increasing hardness. Hence, high-hardness steel yielded by performing heat treatment such as quenching on alloy steel containing a large amount of alloying elements such as Cr and Mo is widely used as abrasion-resistant steel.

For example, JP 4259145 B2 (PTL 1) and JP 4645307 B2 (PTL 2) each propose an abrasion-resistant steel plate whose surface layer part has a hardness of 460 to 590 in Brinell hardness (HB). High surface hardness of this abrasion-resistant steel plate is realized by adding a predetermined amount of alloying elements and performing quenching to form a microstructure mainly composed of martensite.

In the field of abrasion-resistant steel plates, not only the improvement of abrasion resistance but also the prevention of delayed fractures is required. A delayed fracture is a phenomenon that a steel plate fractures suddenly despite the stress applied to the steel plate being not greater than its yield strength. The delayed fracture phenomenon is more likely to occur when the steel plate strength is higher, and is promoted by hydrogen entry into the steel plate. An example of the delayed fracture phenomenon of the abrasion-resistant steel plate is cracking after gas cutting. During gas cutting, the steel plate becomes brittle due to hydrogen entry from combustion gas. Further, because of residual stress after the gas cutting, cracking occurs a few hours to a few days after the cutting. Since the abrasion-resistant steel plate has high hardness, gas cutting is frequently employed. Therefore, the abrasion-resistant steel plate often encounters the problem of delayed fractures after gas cutting (hereafter also referred to as "gas cutting cracking").

JP 5145804 B2 (PTL 3) and JP 5145805 B2 (PTL 4) each propose an abrasion-resistant steel plate whose chemical composition and microstructure are controlled to suppress delayed fractures caused by gas cutting and the like.

CITATION LIST

Patent Literatures

PTL 1: JP 4259145 B2
PTL 2: JP 4645307 B2
PTL 3: JP 5145804 B2
PTL 4: JP 5145805 B2

SUMMARY

Technical Problem

However, with the abrasion-resistant steel plate described in each of PTL 1 and PTL 2, a large amount of alloying elements needs to be added in order to ensure hardness. Typically, an effective way of reducing alloying costs is to decrease the usage of expensive alloying elements such as Mo and Cr and increase the usage of inexpensive alloying elements such as Mn. Increasing the usage of Mn in the abrasion-resistant steel plate described in PTL 1 or PTL 2, however, causes a decrease in gas cutting cracking resistance.

With the abrasion-resistant steel plate described in each of PTL 3 and PTL 4, gas cutting cracking is suppressed to a certain extent, but still the Mn content needs to be reduced in order to prevent delayed fractures.

There is thus difficulty in achieving both gas cutting cracking resistance and abrasion resistance at high level and low cost in the above-mentioned abrasion-resistant steel plates.

It could, therefore, be helpful to provide an abrasion-resistant steel plate that can achieve both delayed fracture resistance and abrasion resistance at high level and low cost. It could also be helpful to provide a method of producing the abrasion-resistant steel plate.

Solution to Problem

As a result of conducting keen examination, we discovered that a delayed fracture after gas cutting in an abrasion-resistant steel plate originates from an intergranular fracture that occurs in prior austenite grain boundaries of martensite microstructure or bainite microstructure, and that the intergranular fracture occurs when the influences of (a) residual stress generated by gas cutting, (b) hydrogen embrittlement caused by hydrogen entering the steel plate from cutting gas during gas cutting, and (c) temper embrittlement of the steel plate due to heating during gas cutting overlap.

We also discovered that a plate thickness central segregation area of the steel plate where Mn and P, which are intergranular embrittlement elements, concentrate is an origin of gas cutting cracking, and that the segregation of the intergranular embrittlement elements to the prior austenite grain boundaries in the plate thickness central segregation area is further facilitated by heating during gas cutting, as a result of which the strength of the prior austenite grain boundaries decreases significantly and gas cutting cracking occurs.

The segregation of Mn and P to the plate thickness center takes place during continuous casting. In the continuous casting, the solidification of molten steel progresses inwardly from the surface. Here, since the solid solubility limit of Mn or P is higher in liquid phase than in solid phase, alloying elements such as Mn and P concentrate into the molten steel from the solidified steel at the solid-liquid phase interface. At the plate thickness central position which is the final solidification part, the molten steel significantly concentrated with the alloying elements solidifies, thus forming the central segregation area.

Based on these discoveries, we further examined how to prevent cracking originated from the central segregation area. We consequently discovered that, by suppressing the central segregation of Mn and P in the continuous casting and also refining the prior austenite grain size in the microstructure of the final steel plate, excellent gas cutting cracking resistance is obtained even when the Mn content in the whole steel plate is high.

The present disclosure is based on these discoveries. We thus provide:

1. An abrasion-resistant steel plate comprising: a chemical composition containing (consisting of), in mass %, C: more than 0.23% and 0.34% or less, Si: 0.01% to 1.0%, Mn: 0.30% to 2.50%, P: 0.020% or less, S: 0.01% or less, Cr: 0.01% to 2.00%, Al: 0.001% to 0.100%, N: 0.01% or less, and a balance consisting of Fe and inevitable impurities; and a microstructure in which a volume fraction of martensite at a depth of 1 mm from a surface of the abrasion-resistant steel plate is 90% or more, and a prior austenite grain size at the mid-thickness of the abrasion-resistant steel plate is 80 μm or less, wherein hardness at a depth of 1 mm from the surface of the abrasion-resistant steel plate is 460 to 590 HBW 10/3000 in Brinell hardness, and a concentration [Mn] of Mn in mass % and a concentration [P] of P in mass % in a plate thickness central segregation area satisfy the following Expression (1):

$$0.04[Mn]+[P]<0.50 \quad (1).$$

2. The abrasion-resistant steel plate according to 1., wherein the chemical composition further contains, in mass %, one or more selected from the group consisting of Cu: 0.01% to 2.0%, Ni: 0.01% to 5.0%, Mo: 0.01% to 3.0%, Nb: 0.001% to 0.100%, Ti: 0.001% to 0.050%, B: 0.0001% to 0.0100%, V: 0.001% to 1.00%, W: 0.01% to 1.5%, Ca: 0.0001% to 0.0200%, Mg: 0.0001% to 0.0200%, and REM: 0.0005% to 0.0500%.

3. The abrasion-resistant steel plate according to 1. or 2., wherein a reduction of area in a tensile test after subjection to temper embrittlement treatment and subsequent hydrogen embrittlement treatment is 10% or more.

4. A method of producing the abrasion-resistant steel plate according to any one of 1. to 3., the method comprising: subjecting molten steel to continuous casting, to form a slab; heating the slab to 1000° C. to 1300° C.; subjecting the heated slab to hot rolling in which reduction rolling with a rolling shape factor of 0.7 or more and a rolling reduction of 7% or more at a plate thickness central part temperature of 950° C. or more is performed three times or more, to obtain a hot rolled steel plate; reheating the hot rolled steel plate to a reheating quenching temperature; and quenching the reheated hot rolled steel plate, wherein the slab has the chemical composition according to 1. or 2., in the continuous casting, light reduction rolling with a rolling reduction gradient of 0.4 mm/m or more is performed twice or more, upstream from a final solidification position of the slab, the reheating quenching temperature is $Ac_3$ to 1050° C., and an average cooling rate from 650° C. to 300° C. in the quenching is 1° C./s or more.

5. The method according to 4., further comprising tempering the quenched hot-rolled steel plate at a tempering temperature of 100° C. to 300° C.

6. A method of producing the abrasion-resistant steel plate according to any one of 1. to 3., the method comprising: subjecting molten steel to continuous casting, to form a slab; heating the slab to 1000° C. to 1300° C.; subjecting the heated slab to hot rolling in which reduction rolling with a rolling shape factor of 0.7 or more and a rolling reduction of 7% or more at a plate thickness central part temperature of 950° C. or more is performed three times or more, to obtain a hot-rolled steel plate; and direct quenching the hot-rolled steel plate, wherein the slab has the chemical composition according to 1. or 2., in the continuous casting, light reduction rolling with a rolling reduction gradient of 0.4 mm/m or more is performed twice or more, upstream from a final solidification position of the slab, a direct quenching temperature in the direct quenching is $Ac_3$ or more, and an average cooling rate from 650° C. to 300° C. in the direct quenching is 1° C./s or more.

7. The method according to 6., further comprising tempering the quenched hot-rolled steel plate at a tempering temperature of 100° C. to 300° C.

Advantageous Effect

It is thus possible to obtain excellent delayed fracture resistance without excessively reducing the Mn content in the whole steel plate, and so achieve both delayed fracture resistance and abrasion resistance in the abrasion-resistant steel plate at low cost. The presently disclosed technique is effective not only for delayed fracture resistance after gas cutting but also for delayed fractures caused by other factors.

DETAILED DESCRIPTION

[Chemical Composition]

Figure 1:
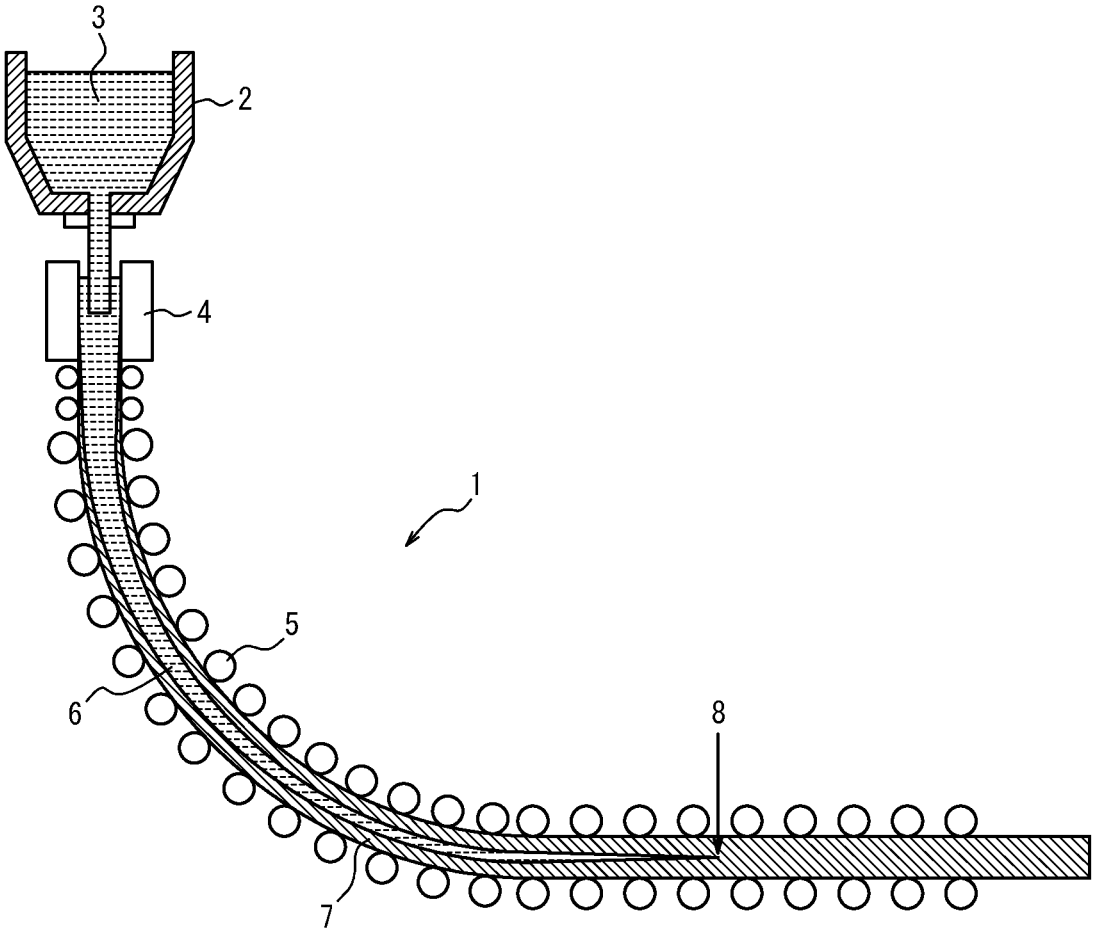
FIG. 1 is a schematic diagram illustrating a final solidification position in continuous casting.

A method of implementing the present disclosure is described in detail below. In the present disclosure, it is important that a steel slab used in an abrasion-resistant steel plate and its production has the chemical composition described above. The reasons for limiting the chemical composition of steel in this way in the present disclosure are described first. In the description, "%" regarding the chemical composition denotes "mass %" unless otherwise noted.

C: More Than 0.23% and 0.34% or Less

C is an essential element for enhancing the hardness of martensite matrix. If the C content is 0.23% or less, the solute C content in martensite microstructure is low, which causes a decrease in abrasion resistance. If the C content is more than 0.34%, weldability and workability decrease. The C content is, therefore, more than 0.23% and 0.34% or less in the present disclosure. The C content is preferably 0.25% to 0.32%.

Si: 0.01% to 1.0%

Si is an element effective in deoxidation. If the Si content is less than 0.01%, the effect is insufficient. Si is also an element that contributes to higher hardness of the steel by solid solution strengthening. However, if the Si content is more than 1.0%, not only ductility and toughness decrease, but also problems such as an increase in the number of inclusions arise. The Si content is therefore 0.01% to 1.0%. The Si content is preferably 0.01% to 0.8%.

Mn: 0.30% to 2.50%

Mn is an element having a function of improving the quench hardenability of the steel. Adding Mn increases the hardness of the steel after quenching, as a result of which abrasion resistance can be improved. If the Mn content is less than 0.30%, the effect is insufficient. The Mn content is therefore 0.30% or more. If the Mn content is more than 2.50%, not only weldability and toughness decrease, but also delayed fracture resistance decreases. The Mn content is therefore 2.50% or less. The Mn content is preferably 0.50% to 2.30%.

P: 0.020% or Less

P is an intergranular embrittlement element. The segregation of P to crystal grain boundaries causes a decrease in the toughness of the steel, and also causes a decrease in delayed fracture resistance. The P content is therefore 0.020% or less. The P content is preferably 0.015% or less. The P content is preferably as low as possible. Accordingly, no lower limit is placed on the P content, and the lower limit may be 0%. Typically, however, P is an element inevitably contained in steel as an impurity, so that in industrial terms the lower limit may be more than 0%. Excessively low P content leads to longer refining time and higher cost, and so the P content is preferably 0.001% or more.

S: 0.01% or Less

S decreases the toughness of the steel, and therefore the S content is 0.01% or less. The S content is preferably 0.005% or less. The S content is preferably as low as possible. Accordingly, no lower limit is placed on the S content, and the lower limit may be 0%. In industrial terms, the lower limit may be more than 0%. Excessively low S content leads to longer refining time and higher cost, and so the S content is preferably 0.0001% or more.

Cr: 0.01% to 2.00%

Cr is an element having a function of improving the quench hardenability of the steel. Adding Cr increases the hardness of the steel after quenching, as a result of which abrasion resistance can be improved. To achieve the effect, the Cr content needs to be 0.01% or more. If the Cr content is more than 2.00%, weldability decreases. The Cr content is therefore 0.01% to 2.00%. The Cr content is preferably 0.05% to 1.8%.

Al: 0.001% to 0.100%

Al is an element that is effective as a deoxidizer and also has an effect of reducing austenite grain size by forming nitride. To achieve the effect, the Al content needs to be 0.001% or more. If the Al content is more than 0.100%, the cleanliness of the steel decreases, and consequently ductility and toughness decrease. The Al content is therefore 0.001% to 0.100%.

N: 0.01% or Less

N is an element that decreases ductility and toughness, and so the N content is 0.01% or less. The N content is preferably as low as possible.

Accordingly, no lower limit is placed on the N content, and the lower limit may be 0%. Typically, however, N is an element inevitably contained in steel as an impurity, so that in industrial terms the lower limit may be more than 0%. Excessively low N content leads to longer refining time and higher cost, and so the N content is preferably 0.0005% or more.

The steel plate used in the present disclosure contains the balance consisting of Fe and inevitable impurities in addition to the components described above.

The steel plate according to the present disclosure has the above-described components as basic components. For improvement in quench hardenability or weldability, the steel plate may optionally contain one or more selected from the group consisting of Cu: 0.01% to 2.0%, Ni: 0.01% to 5.0%, Mo: 0.01% to 3.0%, Nb: 0.001% to 0.100%, Ti: 0.001% to 0.050%, B: 0.0001% to 0.0100%, V: 0.001% to 1.00%, W: 0.01% to 1.5%, Ca: 0.0001% to 0.0200%, Mg: 0.0001% to 0.0200%, and REM: 0.0005% to 0.0500%.

Cu: 0.01% to 2.0%

Cu is an element capable of improving quench hardenability without greatly degrading toughness in base metal and weld joints. To achieve the effect, the Cu content needs to be 0.01% or more. If the Cu content is more than 2.0%, steel plate cracking is caused by a Cu-concentrated layer formed directly below scale. Accordingly, in the case of adding Cu, the Cu content is 0.01% to 2.0%. The Cu content is preferably 0.05% to 1.5%.

Ni: 0.01% to 5.0%

Ni is an element having an effect of enhancing quench hardenability and also improving toughness. To achieve the effect, the Ni content needs to be 0.01% or more. If the Ni content is more than 5.0%, the production cost increases. Accordingly, in the case of adding Ni, the Ni content is 0.01% to 5.0%. The Ni content is preferably 0.05% to 4.5%.

Mo: 0.01% to 3.0%

Mo is an element that improves the quench hardenability of the steel. To achieve the effect, the Mo content needs to be 0.01% or more. If the Mo content is more than 3.0%, weldability decreases. Accordingly, in the case of adding Mo, the Mo content is 0.01% to 3.0%. The Mo content is preferably 0.05% to 2.0%.

Nb: 0.001% to 0.100%

Nb is an element that has an effect of reducing prior austenite grain size by precipitating as carbonitride. To achieve the effect, the Nb content needs to be 0.001% or more. If the Nb content is more than 0.100%, weldability decreases. Accordingly, in the case of adding Nb, the Nb content is 0.001% to 0.100%.

Ti: 0.001% to 0.050%

Ti is an element that has an effect of reducing prior austenite grain size by forming nitride. To achieve the effect, the Ti content needs to be 0.001% or more. If the Ti content is more than 0.050%, the cleanliness of the steel decreases, and consequently ductility and toughness decrease. Accordingly, in the case of adding Ti, the Ti content is 0.001% to 0.050%.

B: 0.0001% to 0.0100%

B is an element that has an effect of improving quench hardenability and thus improving the strength of the steel plate when added in infinitesimal quantity. To achieve the effect, the B content needs to be 0.0001% or more. If the B content is more than 0.0100%, weldability decreases and also quench hardenability decreases. Accordingly, in the case of adding B, the B content is 0.0001% to 0.0100%. The B content is preferably 0.0001% to 0.0050%.

V: 0.001% to 1.00%

V is an element that has an effect of improving the quench hardenability of the steel. To achieve the effect, the V content needs to be 0.001% or more. If the V content is more than 1.00%, weldability decreases. Accordingly, in the case of adding V, the V content is 0.001% to 1.00%.

W: 0.01% to 1.5%

W is an element that has an effect of improving the quench hardenability of the steel. To achieve the effect, the W content needs to be 0.01% or more. If the W content is more than 1.5%, weldability decreases. Accordingly, in the case of adding W, the W content is 0.01% to 1.5%.

Ca: 0.0001% to 0.0200%

Ca is an element that improves weldability by forming oxysulfide having high stability at high temperature. To achieve the effect, the Ca content needs to be 0.0001% or more. If the Ca content is more than 0.0200%, cleanliness decreases and the toughness of the steel is impaired. Accordingly, in the case of adding Ca, the Ca content is 0.0001% to 0.0200%.

Mg: 0.0001% to 0.0200%

Mg is an element that improves weldability by forming oxysulfide having high stability at high temperature. To achieve the effect, the Mg content needs to be 0.0001% or more. If the Mg content is more than 0.0200%, the Mg addition effect is saturated, and the effect appropriate to the content cannot be expected, which is economically disadvantageous.

Accordingly, in the case of adding Mg, the Mg content is 0.0001% to 0.0200%.

REM: 0.0005% to 0.0500%

REM (rare earth metal) is an element that improves weldability by forming oxysulfide having high stability at high temperature. To achieve the effect, the REM content needs to be 0.0005% or more. If the REM content is more than 0.0500%, the REM addition effect is saturated, and the effect appropriate to the content cannot be expected, which is economically disadvantageous. Accordingly, in the case of adding REM, the REM content is 0.0005% to 0.0500%.

[Microstructure]

In addition to having the chemical composition described above, the abrasion-resistant steel plate according to the present disclosure has a microstructure in which the volume fraction of martensite at a depth of 1 mm from the surface of the abrasion-resistant steel plate is 90% or more, and the prior austenite grain size in the plate thickness central part of the abrasion-resistant steel plate is 80 μm or less. The reasons for limiting the microstructure of the steel in this way are described below.

Volume Fraction of Martensite: 90% or More

If the volume fraction of martensite is less than 90%, the hardness of the matrix of the steel plate decreases, so that abrasion resistance decreases. The volume fraction of martensite is therefore 90% or more. Remaining microstructures other than martensite are not limited and may be ferrite, pearlite, austenite, and bainite microstructures. The volume fraction of martensite is preferably as high as possible. Accordingly, no upper limit is placed on the volume fraction, and the upper limit may be 100%. The volume fraction of martensite is a value at a depth position of 1 mm from the surface of the abrasion-resistant steel plate. The volume fraction of martensite can be measured by the method described in the EXAMPLES section.

Prior Austenite Grain Size: 80 μm or Less

If the prior austenite grain size is more than 80 μm, the delayed fracture resistance of the abrasion-resistant steel plate decreases. This is because, as a result of the decrease of the area of the prior austenite grain boundaries, the contents of Mn and P per unit area of the prior austenite grain boundaries increase, and grain boundary embrittlement becomes prominent. The prior austenite grain size is therefore 80 μm or less. The prior austenite grain size is preferably as small as possible. Accordingly, no lower limit is placed on the prior austenite grain size, but the prior austenite grain size is typically 1 μm or more. The prior austenite grain size mentioned here is the equivalent circular diameter of prior austenite grains in the plate thickness central part of the abrasion-resistant steel plate. The prior austenite grain size can be measured by the method described in the EXAMPLES section.

[Central Segregation]

In the present disclosure, it is important that the concentration [Mn] of Mn (mass %) and the concentration [P] of P (mass %) in the plate thickness central segregation area satisfy the following Expression (1):

$$0.04[Mn]+[P]<0.50 \quad (1).$$

As described above, a delayed fracture after gas cutting originates from a part where Mn and P which are intergranular embrittlement elements segregate significantly in the plate thickness central segregation area. Further examination revealed that the influence of P on grain boundary embrittlement is greater than that of Mn. Hence, gas cutting cracking resistance can be improved by controlling the concentrations of Mn and P in the plate thickness central segregation area so as to satisfy Expression (1). No lower limit is placed on the value of (0.04[Mn]+[P]). Typically, however, [Mn] is not less than the Mn content $[Mn]_0$ in the whole steel plate and [P] is not less than the P content $[P]_0$ in the whole steel plate, so that $0.04[Mn]_0+[P]_0 \leq 0.04[Mn]+[P]$. The concentrations [Mn] and [P] of Mn and P in the plate thickness central segregation area can be measured by the method described in the EXAMPLES section.

[Brinell Hardness]

Brinell Hardness: 460 to 590 HBW 10/3000

The abrasion resistance of the steel plate can be improved by increasing the hardness in the steel plate surface layer part. If the hardness in the steel plate surface layer part is less than 460 HBW in Brinell hardness, sufficient abrasion resistance cannot be obtained. If the hardness in the steel plate surface layer part is more than 590 HBW in Brinell hardness, bending workability decreases. Accordingly, in the present disclosure, the hardness in the steel plate surface layer part is 460 to 590 HBW in Brinell hardness. The hardness mentioned here is Brinell hardness at a depth position of 1 mm from the surface of the abrasion-resistant steel plate. The Brinell hardness is a value (HBW 10/3000) measured with a load of 3000 Kgf using tungsten hard balls of 10 mm in diameter. The Brinell hardness can be measured by the method described in the EXAMPLES section.

[Production Method]

A method of producing the abrasion-resistant steel plate according to the present disclosure is described below. The abrasion-resistant steel plate according to the present disclosure can be produced by any of a method of performing reheating quenching (RQ) after hot rolling and a method of performing direct quenching (DQ) after hot rolling.

In a disclosed embodiment involving reheating quenching, the abrasion-resistant steel plate can be produced by sequentially performing the following:

(1) subjecting molten steel to continuous casting to form a slab;

(2) heating the slab to 1000° C. to 1300° C.;

(3) hot rolling the heated slab to obtain a hot-rolled steel plate;

(4-1) reheating the hot-rolled steel plate to a reheating quenching temperature; and (4-2) quenching the reheated hot-rolled steel plate.

In another disclosed embodiment involving direct quenching, the abrasion-resistant steel plate can be produced by sequentially performing the following:

(1) subjecting molten steel to continuous casting to form a slab;

(2) heating the slab to 1000° C. to 1300° C.;

(3) hot rolling the heated slab to obtain a hot-rolled steel plate;

(4) direct quenching the hot-rolled steel plate.

In each of these embodiments, the chemical composition of the slab is as described above. In the continuous casting, light reduction rolling with a rolling reduction gradient of 0.4 mm/m or more is performed twice or more, upstream from the final solidification position of the slab. Moreover, the reheating quenching temperature in the case of performing the reheating quenching is $Ac_3$ to 1050° C., and the direct quenching temperature in the case of performing the direct quenching is $Ac_3$ or more. Further, in each of the reheating quenching and the direct quenching, the average cooling rate from 650° C. to 300° C. is 1° C./s or more. The reasons for limiting the conditions in this way are described below. The temperature mentioned in the following description is the temperature in the plate thickness central part unless otherwise noted. The temperature in the plate thickness central part can be calculated by thermal transfer calculation. The following description applies to both of the case of performing the reheating quenching and the case of performing the direct quenching, unless otherwise noted.

Figure 2:
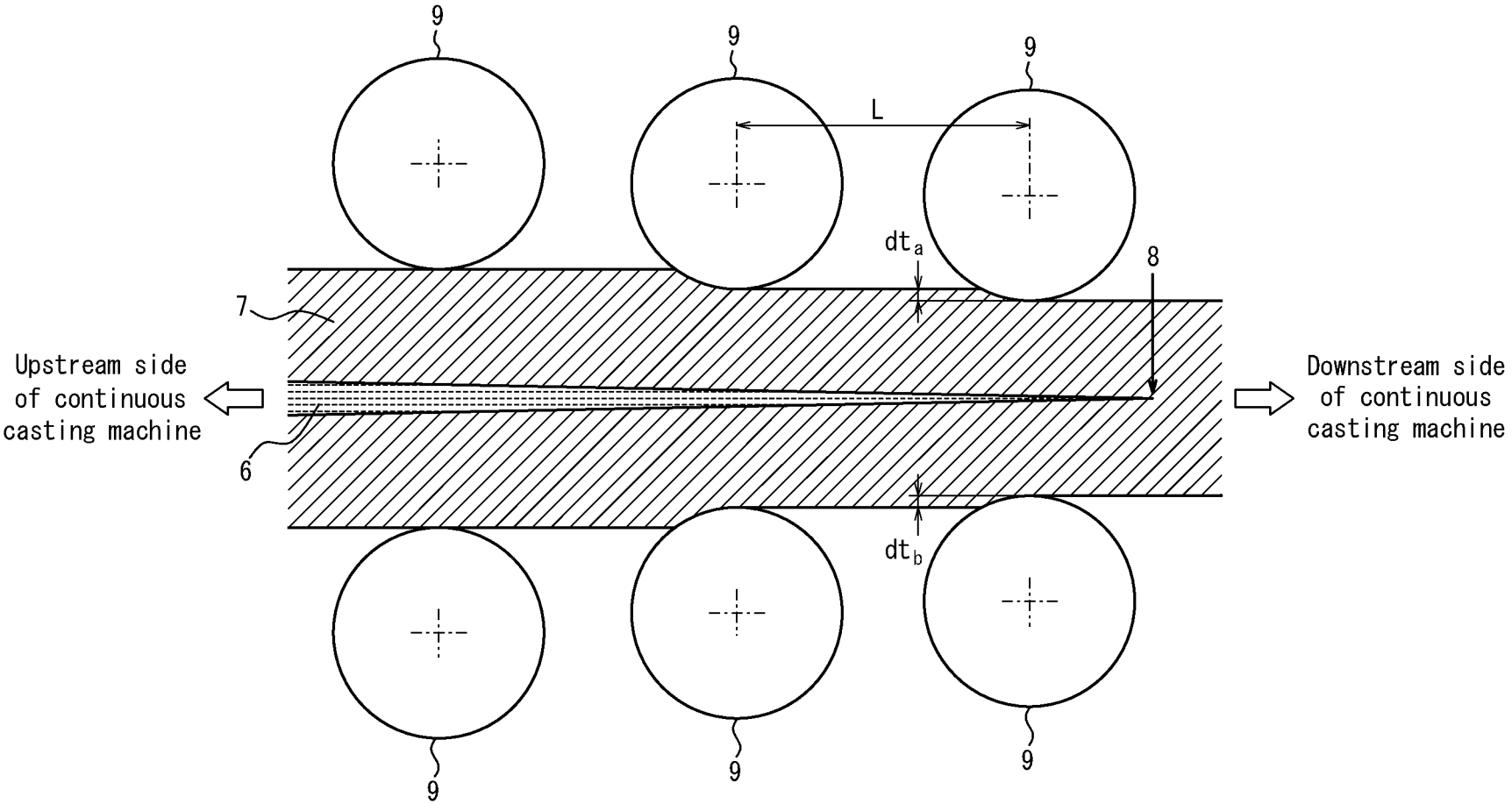
FIG. 2 is a schematic diagram illustrating a continuous casting method according to one of the disclosed embodiments.

Light reduction rolling: perform light reduction rolling with rolling reduction gradient of 0.4 mm/m or more twice or more upstream from final solidification position of the slab Central segregation of a slab produced by a continuous casting machine illustrated in FIG. 1 is formed as a result of alloying elements concentrating into molten steel at the solid-liquid phase interface during solidification progress and the significantly concentrated molten steel solidifying at the final solidification position. Accordingly, by gradually performing reduction rolling upstream from the final solidification position of the slab in the continuous casting machine so that the roll gap decreases from upstream to downstream in the continuous casting line as illustrated in FIG. 2, the molten steel concentrated with the alloying elements is drifted upstream, and the already solidified part is annihilated, with it being possible to reduce central segregation. To achieve the effect, it is necessary to perform, upstream from the final solidification position of the slab, light reduction rolling with a rolling reduction gradient of 0.4 mm/m or more twice or more, i.e., perform reduction rolling such that $(dt_a+dt_b)/L$ in FIG. 2 is 0.4 mm/m or more twice or more. If the number of times light reduction rolling with a rolling reduction gradient of 0.4 mm/m or more is performed is 1 or less, the effect of drifting the molten steel of the non-solidified part upstream is insufficient, and the segregation reduction effect by the light reduction rolling is insufficient. Therefore, in the (1) continuous casting, light reduction rolling with a rolling reduction gradient of 0.4 mm/m or more is performed twice or more, upstream from the final solidification position of the slab. No upper limit is placed on the number of times light reduction rolling with a rolling reduction gradient of 0.4 mm/m or more is performed, yet the number of times is preferably 30 or less in terms of cost-effectiveness of installation of rolls for light reduction rolling. No upper limit is placed on the rolling reduction gradient of the reduction rolling, yet the rolling reduction gradient is preferably 10.0 mm/m or less in terms of protecting the line of the rolls for light reduction rolling. The final solidification position of the slab is detectable by transmitting an electromagnetic acoustic wave through the slab.

Heating Temperature: 1000° C. to 1300° C.

If the heating temperature in the (2) heating is less than 1000° C., deformation resistance in the hot rolling increases, which causes a decrease in productivity. If the heating temperature is more than 1300° C., high-adhesion scale forms, so that a descaling failure occurs. This results in degradation in the surface characteristics of the obtained steel plate. The heating temperature is therefore 1000° C. to 1300° C.

Hot rolling: perform reduction rolling with rolling shape factor of 0.7 or more and rolling reduction of 7% or more at a plate thickness central part temperature of 950° C. or more three times or more With only the slab segregation reduction by light reduction rolling in the continuous casting, it is impossible to realize a segregation state excellent in delayed fracture resistance. Hence, the segregation reduction effect in the hot rolling needs to be used together. By performing high reduction rolling with a rolling reduction of 7% or more at a high temperature of 950° C. or more on the steel three times or more, the segregation reduction effect by facilitating atomic diffusion through strain introduction and austenite microstructure recrystallization is achieved. If the rolling temperature is 950° C. or less or the number of times reduction rolling with a rolling reduction of 7% or more is performed is less than 3, microstructure recrystallization is insufficient, and so the segregation reduction effect cannot be achieved. No upper limit is placed on the rolling reduction, yet the rolling reduction is preferably 40% or less in terms of mill protection. Typically, when the carbon concentration in steel is high, the temperature range between liquidus temperature and solidus temperature widens, and therefore the residence time in the solid-liquid phase coexisting state in which segregation progresses increases, and the central segregation of alloying elements or impurity elements increases. By combining the light reduction rolling and the hot rolling, however, the central segregation can be reduced to such a level that provides favorable delayed fracture resistance, even in the case where the carbon concentration is high as in abrasion-resistant steel.

The strain introduced into the steel plate in the rolling is not uniform in the plate thickness direction, and its distribution in the plate thickness direction depends on the rolling shape factor ($ld/h_m$) defined by the following expression:

$$ld/h_m=\{R(h_i-h_0)\}^{1/2}/\{(h_i+2h_0)/3\}$$

where ld is the projected length of the arc of contact, $h_m$ is the average plate thickness, R is the roll radius, $h_i$ is the plate thickness at entry side, and $h_0$ is the plate thickness at exit side, in each roll pass. To apply strain by rolling to the plate thickness central part having central segregation, the rolling shape factor (ld/hm) needs to be 0.7 or more. If the rolling shape factor is less than 0.7, the strain applied to the steel plate surface layer during the rolling increases, and the strain introduced into the plate thickness central part of the steel plate decreases, which causes insufficient microstructure recrystallization. In such a case, the required segregation reduction effect cannot be achieved. The rolling shape factor is therefore 0.7 or more. The rolling shape factor can be increased by increasing the roll radius or increasing the rolling reduction. No upper limit is placed on the rolling shape factor, yet the rolling shape factor is preferably 3.5 or less in terms of mill protection.

Reheating Quenching Temperature: $Ac_3$ to 1050° C.

In the case of performing the reheating quenching, if the heating temperature (reheating quenching temperature) in the (4-1) reheating is less than $Ac_3$ point, the microstructure after the hot rolling remains non-transformed, and a predetermined microstructure mainly composed of martensite cannot be obtained. This causes a decrease in hardness, and thus a decrease in abrasion resistance. If the heating temperature is more than 1050° C., austenite grains coarsen during the heating, causing the prior austenite grain size after the quenching to be more than 80 μm. The reheating quenching temperature is, therefore, $Ac_3$ to 1050° C.

Direct Quenching Temperature: $Ac_3$ or More

In the case of performing the direct quenching, if the quenching temperature (direct quenching temperature) in the (4) direct quenching is less than $Ac_3$ point, the proportions of microstructures other than martensite increase, and a predetermined microstructure mainly composed of martensite cannot be obtained. This causes a decrease in hardness, and thus a decrease in abrasion resistance. The direct quenching temperature is therefore $Ac_3$ or more. No upper limit is placed on the direct quenching temperature, yet the direct quenching temperature is 1300° C. or less because the upper limit of the heating temperature in the hot rolling is 1300° C. The "direct quenching temperature" mentioned here is the steel plate surface temperature at the quenching start. The direct quenching temperature can be measured using a radiation thermometer immediately before the quenching.

Average Cooling Rate from 650° C. to 300° C.: 1° C./s or More

In each of the case of performing the reheating quenching and the case of performing the direct quenching, if the average cooling rate from 650° C. to 300° C. in the quenching is less than 1° C./s, ferrite or pearlite microstructure is mixed in the microstructure of the steel plate after the quenching, so that the hardness of the matrix decreases and as a result the abrasion resistance decreases. The average cooling rate from 650° C. to 300° C. in the quenching is therefore 1° C./s or more. No upper limit is placed on the average cooling rate, yet the average cooling rate is preferably 300° C./s or less because, in a typical line, the microstructure varies significantly in the rolling direction and the plate transverse direction of the steel plate when the average cooling rate is more than 300° C./s.

The cooling end temperature in the quenching is not limited, but is preferably 300° C. or less because a cooling end temperature of more than 300° C. may cause a decrease in martensite microstructure ratio and a decrease in the hardness of the steel plate. No lower limit is placed on the cooling end temperature, yet the cooling end temperature is preferably 50° C. or more because production efficiency decreases if cooling is continued needlessly.

In each of the case of performing the reheating quenching and the case of performing the direct quenching, the following may be performed after the quenching:

(5) Tempering the Quenched Hot-Rolled Steel Plate to a Temperature of 100° C. to 300° C.

Tempering temperature: 100° C. to 300° C.

If the tempering temperature in the tempering process is 100° C. or more, the toughness and workability of the steel plate can be improved. If the tempering temperature is more than 300° C., martensite microstructure softens significantly, and consequently the abrasion resistance decreases. The tempering temperature is therefore 100° C. to 300° C.

After heating the steel plate to the tempering temperature, the steel plate may be subjected to air cooling. The soaking time in the tempering treatment is not limited, but is preferably 1 min or more in terms of enhancing the tempering effect. Long time soaking, meanwhile, leads to a decrease in hardness, and accordingly the soaking time is preferably 3 hr or less.

EXAMPLES

More detailed description is given below, based on examples. The following examples merely represent preferred examples, and the present disclosure is not limited to these examples.

First, slabs having the chemical compositions listed in Table 1 were produced by the continuous casting method. In the production of some of the slabs, light reduction rolling with a rolling reduction gradient of 0.4 mm/m or more was performed upstream from the final solidification position of the slab, in order to reduce the segregation of the plate thickness central part. The conditions of the light reduction rolling are listed in Table 2. The $Ac_3$ temperature in Table 2 is calculated according to the following expression:

$$Ac_3(°\,C.)=937-5722.765([C]/12.01-[Ti]/47.87)+56[Si]-19.7[Mn]-16.3[Cu]-26.6[Ni]-4.9[Cr]+38.1[Mo]+124.8[V]-136.3[Ti]-19[Nb]+3315[B]$$

where [M] is the content (mass %) of element M, and [M]=0 in the case where element M is not added.

Each obtained slab was then sequentially subjected to the processes of heating, hot rolling, and direct quenching or reheating quenching, thus obtaining a steel plate. Some of the steel plates were further reheated for tempering after the quenching. The treatment conditions in each of the processes are listed in Table 2. Cooling in the quenching was performed by, while passing the steel plate, injecting water of a high flow rate to the front and back surfaces of the steel plate. The cooling rate in the quenching is the average cooling rate from 650° C. to 300° C. calculated by thermal transfer calculation. The cooling was performed to 300° C. or less.

For each of the obtained steel plates, the Mn content and the P content in the plate thickness central segregation area, the volume fraction of martensite, and the prior austenite grain size were measured by the following methods. The measurement results are listed in Table 3.

[Mn Content and P Content in Plate Thickness Central Segregation Area]

To produce a measurement sample, a central part of the obtained steel plate in both of the plate transverse direction and the plate thickness direction was cut out in a rectangular parallelopiped shape with a width of 500 mm in the plate transverse direction and a thickness of 3 mm in the plate thickness direction. The cut-out steel was further cut into 20 equal parts in the plate transverse direction, to obtain 20 measurement samples with a width of 25 mm in the plate transverse direction. The surface (a width of 25 mm in the plate transverse direction x a thickness of 3 mm in the plate thickness direction) of the measurement sample orthogonal to the rolling direction was mirror polished, and then immediately quantitative analysis by an electron probe microanalyzer (EPMA) was conducted with the mirror-polished surface as a measurement plane.

The conditions of the EPMA measurement were as follows. The maximum value of (0.04[Mn]+[P]) in the below-mentioned measurement range was taken to be the value of (0.04[Mn]+[P]) in the present disclosure.

(EPMA Measurement Conditions)

accelerating voltage: 20 kV irradiation current: 0.5 μA cumulative time: 0.15 sec beam diameter: 15 μm measurement range: height 3 mm×width 25 mm×20 samples.

[Volume Fraction of Martensite]

The abrasion resistance of a steel plate mainly depends on the hardness of the surface layer part. Accordingly, a sample was collected from the center of each obtained steel plate in the plate transverse direction so that the observation position was a depth position of 1 mm from the surface. The surface of the sample was mirror polished and further etched with nital, and then an image of a range of 10 mm×10 mm was captured using a scanning electron microscope (SEM). The captured image was analyzed using an image analyzer to calculate the area fraction of martensite, and the calculated value was taken to be the volume fraction of martensite in the present disclosure.

[Prior Austenite Grain Size]

A measurement sample for the prior austenite grain size was collected from the plate thickness central part having central segregation as an origin of gas cutting cracking, at the center of the steel plate in the width direction. The surface of the sample was mirror polished and further etched with picric acid, and then an image of a range of 10 mm×10 mm was captured using an optical microscope. The captured image was analyzed using an image analyzer to calculate the prior austenite grain size. Here, the prior austenite grain size was calculated as an equivalent circular diameter.

Furthermore, for each of the obtained steel plates, the hardness and the delayed fracture resistance were evaluated by the following methods. The evaluation results are listed in Table 3.

[Hardness (Brinell Hardness)]

The hardness in the surface layer part of the steel plate was measured as an index of the abrasion resistance. A test piece for the measurement was collected from each obtained steel plate so that the observation position was a depth position of 1 mm from the surface of the steel plate. After mirror polishing the surface of the test piece, the Brinell hardness was measured in accordance with JIS Z 2243 (2008). The measurement was performed with a load of 3000 Kgf using tungsten hard balls of 10 mm in diameter.

[Delayed Fracture Resistance Evaluation Test]

When a microstructure mainly composed of martensite is heated to about 400° C., temper embrittlement, i.e., P atoms present near prior austenite grain boundaries diffusing into the prior austenite grain boundaries and thus making the grain boundaries brittle, occurs. Since a higher concentration of P is present in the central segregation area of the steel plate than in the other areas, the temper embrittlement is most noticeable in the central segregation area. In the case of subjecting the steel plate to gas cutting, this temper embrittlement area inevitably appears in the vicinity of the cutting surface. Besides, hydrogen contained in gas used for the gas cutting enters the steel plate from the gas cutting surface, causing hydrogen embrittlement. A delayed fracture after gas cutting originates from cracking of prior austenite grain boundaries that have become significantly brittle due to such temper embrittlement and hydrogen embrittlement.

Hence, to evaluate the delayed fracture resistance after temper embrittlement and hydrogen embrittlement, a test was conducted according to the following procedure. First, the steel plate was heated to 400° C. and then air cooled, to apply temper embrittlement treatment. After this, a JIS No. 14A round bar tensile test piece (JIS Z 2241 (2014)) with a parallel portion diameter of 5 mm and a parallel portion length of 30 mm was collected from the plate thickness central part at the plate width center so that the test piece length was parallel to the plate transverse direction. The round bar tensile test piece was further immersed in a 10% ammonium thiocyanate solution of 25° C. for 72 hr, to cause the tensile test piece to absorb hydrogen. Subsequently, to prevent the diffusion of hydrogen from the tensile test piece, the surface of the tensile test piece was galvanized to a thickness of 10 μm to 15 μm in a plating bath composed of $ZnCl_2$ and $NH_4Cl$. The resultant tensile test piece was subjected to a tensile test with a strain rate of $1.1\times10^{-5}$/sec, and the reduction of area after fracture was measured in accordance with JIS Z 2241 (2014). The tensile test was conducted five times each, and the average value of the reductions of area was used for the evaluation. The total hydrogen release amount when a sample subjected to hydrogen absorption under the same conditions as the above-mentioned tensile test piece was heated to 400° C. by a device for thermal desorption analysis of hydrogen was 0.8 ppm to 1.1 ppm.

TABLE 1

| Steel | Chemical composition (mass %)* | | | | | | | | | | | |
|---|---|---|---|---|---|---|---|---|---|---|---|---|
| sample ID | C | Si | Mn | P | S | Cr | Al | N | Cu | Ni | Nb | Mo |
| A | 0.24 | 0.2 | 1.51 | 0.013 | 0.0012 | 0.67 | 0.026 | 0.0034 | — | — | — | — |
| B | 0.34 | 0.3 | 2.32 | 0.015 | 0.0026 | 0.49 | 0.040 | 0.0056 | — | — | — | — |
| C | 0.28 | 0.6 | 0.54 | 0.005 | 0.0007 | 1.31 | 0.033 | 0.0019 | — | — | — | — |
| D | 0.26 | 0.4 | 1.29 | 0.007 | 0.0030 | 0.85 | 0.016 | 0.0041 | — | — | — | — |
| E | 0.25 | 0.4 | 1.74 | 0.018 | 0.0005 | 1.53 | 0.055 | 0.0025 | — | — | 0.031 | — |
| F | 0.30 | 0.3 | 0.83 | 0.002 | 0.0058 | 0.70 | 0.022 | 0.0029 | 0.4 | — | — | — |
| G | 0.34 | 0.2 | 0.70 | 0.010 | 0.0013 | 1.15 | 0.035 | 0.0048 | — | 2.5 | — | — |
| H | 0.32 | 0.1 | 2.25 | 0.004 | 0.0006 | 0.96 | 0.024 | 0.0021 | — | — | — | — |
| I | 0.29 | 0.3 | 1.40 | 0.012 | 0.0015 | 0.75 | 0.028 | 0.0031 | — | — | — | 0.4 |
| J | 0.33 | 0.2 | 1.10 | 0.005 | 0.0006 | 0.53 | 0.026 | 0.0033 | — | — | — | — |
| K | 0.32 | 0.3 | 1.02 | 0.005 | 0.0030 | 1.22 | 0.017 | 0.0031 | — | — | — | — |
| L | 0.31 | 0.3 | 1.19 | 0.011 | 0.0032 | 1.16 | 0.012 | 0.0048 | — | — | — | — |
| M | 0.26 | 0.2 | 1.27 | 0.005 | 0.0013 | 1.23 | 0.030 | 0.0028 | — | — | — | — |
| N | 0.26 | 0.3 | 0.93 | 0.007 | 0.0013 | 0.70 | 0.036 | 0.0018 | — | — | — | — |
| O | 0.27 | 0.4 | 1.30 | 0.010 | 0.0016 | 0.39 | 0.043 | 0.0025 | — | — | — | — |
| P | 0.31 | 0.3 | 1.14 | 0.012 | 0.0021 | 1.45 | 0.027 | 0.0035 | — | — | — | — |
| Q | 0.32 | 0.3 | 0.75 | 0.008 | 0.0009 | 0.89 | 0.017 | 0.0019 | — | — | 0.018 | — |
| R | 0.20 | 0.1 | 1.64 | 0.010 | 0.0021 | 0.49 | 0.026 | 0.0021 | — | 0.8 | — | 0.3 |
| S | 0.29 | 0.3 | 0.98 | 0.024 | 0.0015 | 0.75 | 0.013 | 0.0036 | — | — | — | — |
| T | 0.33 | 0.5 | 1.70 | 0.018 | 0.0007 | 0.36 | 0.034 | 0.0028 | — | 0.5 | — | — |
| U | 0.28 | 0.4 | 1.91 | 0.017 | 0.0015 | 0.87 | 0.022 | 0.0050 | — | — | — | 0.5 |

| Steel | Chemical composition (mass %)* | | | | | | | |
|---|---|---|---|---|---|---|---|---|
| sample ID | Ti | B | W | V | Ca | Mg | REM | Remarks |
| A | — | — | — | — | — | — | — | Conforming steel |
| B | — | — | — | — | — | — | — | Conforming steel |
| C | — | — | — | — | — | — | — | Conforming steel |
| D | — | — | — | — | — | — | — | Conforming steel |

TABLE 1-continued

| | | | | | | | | |
|---|---|---|---|---|---|---|---|---|
| E | — | — | — | — | — | — | — | Conforming steel |
| F | — | — | — | — | — | — | — | Conforming steel |
| G | — | — | — | — | — | — | — | Conforming steel |
| H | — | — | 0.3 | — | — | — | — | Conforming steel |
| I | — | — | — | — | — | — | — | Conforming steel |
| J | 0.020 | — | — | — | — | — | — | Conforming steel |
| K | — | — | — | — | — | 0.0035 | — | Conforming steel |
| L | — | 0.0025 | — | — | — | — | — | Conforming steel |
| M | 0.025 | 0.0014 | — | — | — | — | — | Conforming steel |
| N | — | — | — | 0.40 | — | — | — | Conforming steel |
| O | — | — | — | — | 0.0031 | — | — | Conforming steel |
| P | — | — | — | — | — | — | 0.0081 | Conforming steel |
| Q | — | — | — | 0.08 | — | — | — | Conforming steel |
| R | — | — | — | — | — | — | — | Comparative steel |
| S | — | 0.0031 | 0.2 | — | 0.0013 | — | — | Comparative steel |
| T | 0.035 | — | — | — | — | — | — | Conforming steel |
| U | — | 0.0030 | — | — | — | — | 0.0058 | Conforming steel |

*Balance consisting of Fe and inevitable impurities.

Underlines indicate outside presently disclosed range.

TABLE 2

| | | Continuous casting | | Hot rolling | | Quenching | | | | | |
|---|---|---|---|---|---|---|---|---|---|---|---|
| No. | Steel sample ID | Number of times of light reduction rolling*1 | Heating Heating temperature (° C.) | Final plate thickness (mm) | Number of times of high reduction rolling*2 | Reheating quenching temperature (° C.) | Direct quenching temperature (° C.) | $Ac_3$ (° C.) | Cooling rate*3 (° C./sec) | Tempering Tempering temperature (° C.) | Remarks |
| 1 | A | 4 | 1030 | 40 | 3 | 860 | — | 801 | 26 | — | Example |
| 2 | B | 5 | 1130 | 60 | 4 | 810 | — | 744 | 11 | — | Example |
| 3 | C | 4 | 1070 | 15 | 3 | 860 | — | 820 | 86 | — | Example |
| 4 | D | 2 | 1160 | 26 | 3 | 850 | — | 806 | 50 | 150 | Example |
| 5 | E | 3 | 1050 | 31 | 3 | 1000 | — | 798 | 38 | — | Example |
| 6 | F | 4 | 1120 | 85 | 3 | 830 | — | 785 | 3 | — | Example |
| 7 | G | 3 | 1180 | 70 | 3 | 740 | — | 700 | 8 | 200 | Example |
| 8 | H | 5 | 1100 | 45 | 5 | 800 | — | 741 | 16 | 250 | Example |
| 9 | I | 3 | 1150 | 18 | 6 | 900 | — | 800 | 76 | — | Example |
| 10 | J | 6 | 1130 | 30 | 6 | 930 | — | 766 | 41 | — | Example |
| 11 | K | 3 | 1080 | 38 | 3 | 840 | — | 775 | 28 | 200 | Example |
| 12 | L | 2 | 1150 | 17 | 3 | 910 | — | 785 | 80 | — | Example |
| 13 | M | 2 | 1100 | 34 | 4 | 860 | — | 797 | 35 | — | Example |
| 14 | N | 4 | 1070 | 40 | 5 | 920 | — | 858 | 25 | 270 | Example |
| 15 | O | 4 | 1050 | 60 | 3 | 860 | — | 803 | 11 | — | Example |
| 16 | P | 3 | 1180 | 24 | 5 | 830 | — | 777 | 64 | — | Example |
| 17 | Q | 2 | 1150 | 39 | 4 | 850 | — | 792 | 28 | 150 | Example |
| 18 | R | 3 | 1130 | 28 | 3 | 870 | — | 803 | 56 | — | Comparative Example |
| 19 | S | 2 | 1070 | 60 | 3 | 880 | — | 803 | 10 | — | Comparative Example |
| 20 | T | 2 | 1080 | 38 | 0 | 850 | — | 759 | 29 | 200 | Comparative Example |
| 21 | U | 0 | 1120 | 25 | 3 | 880 | — | 813 | 54 | — | Comparative Example |
| 22 | B | 4 | 1050 | 32 | 3 | 1070 | — | 744 | 35 | — | Comparative Example |
| 23 | C | 3 | 1100 | 39 | 5 | 760 | — | 820 | 28 | — | Comparative Example |
| 24 | A | 3 | 1170 | 65 | 3 | 860 | — | 801 | 0.1 | — | Comparative Example |
| 25 | I | 3 | 1120 | 32 | 4 | 860 | — | 800 | 36 | 360 | Comparative Example |
| 26 | D | 4 | 1130 | 50 | 3 | — | 856 | 806 | 14 | — | Example |
| 27 | E | 6 | 1100 | 25 | 4 | — | 825 | 798 | 52 | — | Example |
| 28 | I | 5 | 1170 | 32 | 3 | — | 841 | 800 | 36 | 200 | Example |
| 29 | M | 4 | 1100 | 15 | 5 | — | 808 | 797 | 86 | — | Example |
| 30 | E | 2 | 1050 | 45 | 0 | — | 847 | 798 | 15 | — | Comparative Example |
| 31 | B | 0 | 1080 | 36 | 3 | — | 827 | 744 | 30 | — | Comparative Example |
| 32 | J | 4 | 1100 | 65 | 3 | — | 895 | 766 | 0.1 | — | Comparative Example |

TABLE 2-continued

| No. | Steel sample ID | Continuous casting Number of times of light reduction rolling*1 | Heating Heating temperature (° C.) | Hot rolling Final plate thickness (mm) | Hot rolling Number of times of high reduction rolling*2 | Quenching Reheating quenching temperature (° C.) | Quenching Direct quenching temperature (° C.) | $Ac_3$ (° C.) | Cooling rate*3 (° C./sec) | Tempering Tempering temperature (° C.) | Remarks |
|---|---|---|---|---|---|---|---|---|---|---|---|
| 33 | N | 3 | 1050 | 21 | 3 | — | 789 | 858 | 69 | — | Comparative Example |
| 34 | H | 5 | 1120 | 19 | 3 | — | 779 | 741 | 75 | 350 | Comparative Example |

*1Number of times light reduction rolling with rolling reduction gradient of 0.4 mm/m or more was performed upstream from final solidification position of slab.
*2Number of times reduction rolling with rolling shape ratio of 0.7 or more and rolling reduction of 7% or more at a plate thickness central part temperature of 950° C. or more was performed.
*3Average cooling rate from 650 to 300° C.
Underlines indicate outside presently disclosed range.

TABLE 3

| No. | Chemical composition Steel sample ID | Central segregation 0.04 [Mn] + [P] | Microstructure Volume fraction of martensite (%) | Microstructure Prior austenite grain size (μm) | Evaluation Brinell hardness (HBW 10/3000) | Evaluation Reduction of area* (%) | Remarks |
|---|---|---|---|---|---|---|---|
| 1 | A | 0.33 | 99 | 17 | 469 | 18 | Example |
| 2 | B | 0.42 | 98 | 14 | 572 | 14 | Example |
| 3 | C | 0.11 | 100 | 18 | 498 | 22 | Example |
| 4 | D | 0.23 | 100 | 18 | 475 | 19 | Example |
| 5 | E | 0.46 | 98 | 74 | 470 | 12 | Example |
| 6 | F | 0.08 | 98 | 16 | 514 | 24 | Example |
| 7 | G | 0.22 | 99 | 13 | 553 | 17 | Example |
| 8 | H | 0.21 | 98 | 14 | 534 | 18 | Example |
| 9 | I | 0.30 | 100 | 21 | 515 | 15 | Example |
| 10 | J | 0.13 | 100 | 23 | 546 | 20 | Example |
| 11 | K | 0.15 | 98 | 16 | 518 | 22 | Example |
| 12 | L | 0.29 | 100 | 20 | 536 | 16 | Example |
| 13 | M | 0.18 | 100 | 14 | 490 | 21 | Example |
| 14 | N | 0.17 | 98 | 22 | 470 | 25 | Example |
| 15 | O | 0.26 | 97 | 18 | 488 | 18 | Example |
| 16 | P | 0.29 | 100 | 17 | 522 | 16 | Example |
| 17 | Q | 0.19 | 100 | 14 | 526 | 19 | Example |
| 18 | R | 0.29 | 100 | 22 | 436 | 18 | Comparative Example |
| 19 | S | 0.55 | 98 | 19 | 503 | 3 | Comparative Example |
| 20 | T | 0.51 | 99 | 16 | 534 | 5 | Comparative Example |
| 21 | U | 0.56 | 100 | 19 | 508 | 3 | Comparative Example |
| 22 | B | 0.44 | 98 | 93 | 565 | 7 | Comparative Example |
| 23 | C | 0.13 | 73 | 15 | 326 | 20 | Comparative Example |
| 24 | A | 0.35 | 0 | — | 191 | 24 | Comparative Example |
| 25 | I | 0.33 | 98 | 20 | 430 | 20 | Comparative Example |
| 26 | D | 0.21 | 99 | 53 | 489 | 19 | Example |
| 27 | E | 0.41 | 98 | 40 | 480 | 14 | Example |
| 28 | I | 0.28 | 100 | 44 | 498 | 18 | Example |
| 29 | M | 0.16 | 98 | 33 | 479 | 21 | Example |
| 30 | E | 0.52 | 98 | 53 | 475 | 4 | Comparative Example |
| 31 | B | 0.54 | 98 | 50 | 564 | 3 | Comparative Example |
| 32 | J | 0.22 | 0 | — | 202 | 25 | Comparative Example |
| 33 | N | 0.22 | 70 | 38 | 369 | 20 | Comparative Example |
| 34 | H | 0.23 | 98 | 36 | 443 | 19 | Comparative Example |

*Reduction of area in tensile test after subjection to temper embrittlement treatment and subsequent hydrogen embrittlement treatment.
Underlines indicate outside presently disclosed range.

As can be understood from the results in Table 3, each abrasion-resistant steel plate satisfying the conditions according to the present disclosure had both excellent hardness of 460 HBW 10/3000 or more in Brinell hardness and excellent ductility, i.e. delayed fracture resistance, of 10% or more in reduction of area in the tensile test after subjection to temper embrittlement treatment and hydrogen embrittlement treatment. Since the reduction of area is preferably as high as possible, no upper limit is placed on the reduction of area, yet the reduction of area is typically 50% or less. On the other hand, each comparative example steel plate not satisfying the conditions according to the present disclosure was inferior in at least one of hardness and delayed fracture resistance.

For example, steel plate No. 18 with low C content had low hardness, due to low solute C content in martensite matrix. Steel plate No. 19 with high P content had poor delayed fracture resistance, due to high P concentration in the central segregation area. Steel plates No. 20 and 30 had poor delayed fracture resistance, because high reduction rolling in the hot rolling was insufficient and so the degree of central segregation of Mn and P which are intergranular embrittlement elements was high. Steel plates No. 21 and 31 had poor delayed fracture resistance because the light reduction rolling conditions in the continuous casting were inappropriate and so the degree of central segregation of Mn and P which are intergranular embrittlement elements was high. Steel plate No. 22 had poor delayed fracture resistance because the prior austenite grain size increased due to high reheating quenching temperature. Steel plate No. 23 had poor hardness because the reheating quenching temperature was less than $Ac_3$ and as a result the volume fraction of martensite decreased. Steel plate No. 24 had poor hardness because martensite transformation did not occur due to low cooling rate in the reheating quenching. Steel plates No. 25 and 34 had poor hardness because softening occurred due to high tempering temperature. Steel plate No. 32 had poor hardness because martensite transformation did not occur due to low cooling rate in the direct quenching. Steel plate No. 33 had poor hardness, because the direct quenching temperature was less than $Ac_3$ and as a result the volume fraction of martensite decreased.

REFERENCE SIGNS LIST

1 continuous casting machine
2 tundish
3 molten steel
4 mold
5 roll
6 non-solidified layer
7 slab (solidified area)
8 final solidification position
9 rolling mill roll

The invention claimed is:

1. An abrasion-resistant steel plate comprising:
a chemical composition containing, in mass %,
C: more than 0.23% and 0.34% or less,
Si: 0.01% to 1.0%,
Mn: 0.30% to 2.50%,
P: 0.020% or less,
S: 0.01% or less,
Cr: 0.01% to 2.00%,
Al: 0.001% to 0.100%,
N: 0.01% or less, and
a balance consisting of Fe and inevitable impurities; and
a microstructure in which a volume fraction of martensite at a depth of 1 mm from a surface of the abrasion-resistant steel plate is 90% or more, and a prior austenite grain size at the mid-thickness of the abrasion-resistant steel plate is 80 μm or less,
wherein hardness at a depth of 1 mm from the surface of the abrasion-resistant steel plate is 460 to 590 HBW 10/3000 in Brinell hardness, and
a concentration [Mn] of Mn in mass % and a concentration [P] of P in mass % in a plate thickness central segregation area satisfy the following Expression (1):

$$0.04[Mn]+[P]<0.50 \quad (1).$$

2. The abrasion-resistant steel plate according to claim 1, wherein the chemical composition further contains, in mass %, one or more elements selected from the group consisting of
Cu: 0.01% to 2.0%,
Ni: 0.01% to 5.0%,
Mo: 0.01% to 3.0%,
Nb: 0.001% to 0.100%,
Ti: 0.001% to 0.050%,
B: 0.0001% to 0.0100%,
V: 0.001% to 1.00%,
W: 0.01% to 1.5%,
Ca: 0.0001% to 0.0200%,
Mg: 0.0001% to 0.0200%, and
REM: 0.0005% to 0.0500%.

3. The abrasion-resistant steel plate according to claim 1, wherein a reduction of area in a tensile test of the abrasion-resistant steel plate after subjecting the abrasion-resistant steel plate to temper embrittlement treatment and subsequent hydrogen embrittlement treatment is 10% or more.

4. The abrasion-resistant steel plate according to claim 2, wherein a reduction of area in a tensile test of the abrasion-resistant steel plate after subjecting the abrasion-resistant steel plate to temper embrittlement treatment and subsequent hydrogen embrittlement treatment is 10% or more.

5. A method of producing the abrasion-resistant steel plate according to claim 1, the method comprising:
subjecting molten steel to continuous casting, to form a slab;
heating the slab to 1000° C. to 1300° C.;
subjecting the heated slab to hot rolling in which reduction rolling with a rolling shape factor of 0.7 or more and a rolling reduction of 7% or more at a plate thickness central part temperature of 950° C. or more is performed three times or more, to obtain a hot-rolled steel plate;
reheating the hot-rolled steel plate to a reheating quenching temperature; and
quenching the reheated hot-rolled steel plate,
wherein the slab has the chemical composition according to claim 1,
in the continuous casting, light reduction rolling with a rolling reduction gradient of 0.4 mm/m or more is performed twice or more, upstream from a final solidification position of the slab,
the reheating quenching temperature is $Ac_3$ to 1050° C., and
an average cooling rate from 650° C. to 300° C. in the quenching is 1° C./s or more.

6. A method of producing the abrasion-resistant steel plate according to claim 2, the method comprising:
subjecting molten steel to continuous casting, to form a slab;
heating the slab to 1000° C. to 1300° C.;
subjecting the heated slab to hot rolling in which reduction rolling with a rolling shape factor of 0.7 or more and a rolling reduction of 7% or more at a plate thickness central part temperature of 950° C. or more is performed three times or more, to obtain a hot-rolled steel plate;
reheating the hot-rolled steel plate to a reheating quenching temperature; and
quenching the reheated hot-rolled steel plate,
wherein the slab has the chemical composition according to claim 2,
in the continuous casting, light reduction rolling with a rolling reduction gradient of 0.4 mm/m or more is performed twice or more, upstream from a final solidification position of the slab,
the reheating quenching temperature is $Ac_3$ to 1050° C., and an average cooling rate from 650° C. to 300° C. in the quenching is 1° C./s or more.

7. The method according to claim 5, further comprising tempering the quenched hot-rolled steel plate at a tempering temperature of 100° C. to 300° C.

8. The method according to claim 6, further comprising tempering the quenched hot-rolled steel plate at a tempering temperature of 100° C. to 300° C.

9. A method of producing the abrasion-resistant steel plate according to claim 1, the method comprising:

subjecting molten steel to continuous casting, to form a slab;

heating the slab to 1000° C. to 1300° C.;

subjecting the heated slab to hot rolling in which reduction rolling with a rolling shape factor of 0.7 or more and a rolling reduction of 7% or more at a plate thickness central part temperature of 950° C. or more is performed three times or more, to obtain a hot-rolled steel plate; and direct quenching the hot-rolled steel plate, wherein the slab has the chemical composition according to claim 1, in the continuous casting, light reduction rolling with a rolling reduction gradient of 0.4 mm/m or more is performed twice or more, upstream from a final solidification position of the slab, a direct quenching temperature in the direct quenching is $Ac_3$ or more, and an average cooling rate from 650° C. to 300° C. in the direct quenching is 1° C./s or more.

10. A method of producing the abrasion-resistant steel plate according to claim 2, the method comprising:

subjecting molten steel to continuous casting, to form a slab;

heating the slab to 1000° C. to 1300° C.;

subjecting the heated slab to hot rolling in which reduction rolling with a rolling shape factor of 0.7 or more and a rolling reduction of 7% or more at a plate thickness central part temperature of 950° C. or more is performed three times or more, to obtain a hot-rolled steel plate; and direct quenching the hot-rolled steel plate, wherein the slab has the chemical composition according to claim 2, in the continuous casting, light reduction rolling with a rolling reduction gradient of 0.4 mm/m or more is performed twice or more, upstream from a final solidification position of the slab, a direct quenching temperature in the direct quenching is $Ac_3$ or more, and an average cooling rate from 650° C. to 300° C. in the direct quenching is 1° C./s or more.

11. The method according to claim 9, further comprising tempering the quenched hot-rolled steel plate at a tempering temperature of 100° C. to 300° C.

12. The method according to claim 10, further comprising tempering the quenched hot-rolled steel plate at a tempering temperature of 100° C. to 300° C.

13. The abrasion-resistant steel plate according to claim 1, wherein the prior austenite grain size at the mid-thickness of the abrasion-resistant steel plate is 13 μm or more and 80 μm or less.

* * * * *